US010247469B2

(12) United States Patent
Suh et al.

(10) Patent No.: US 10,247,469 B2
(45) Date of Patent: Apr. 2, 2019

(54) REFRIGERATOR

(71) Applicant: LG ELECTRONICS INC., Seoul (KR)

(72) Inventors: Eugene Suh, Seoul (KR); Hangbok Lee, Seoul (KR); Minsub Kim, Seoul (KR); Jungkyu Son, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 15/327,399

(22) PCT Filed: Oct. 14, 2015

(86) PCT No.: PCT/KR2015/010813

§ 371 (c)(1),
(2) Date: Jan. 19, 2017

(87) PCT Pub. No.: WO2016/060456

PCT Pub. Date: Apr. 21, 2016

(65) Prior Publication Data

US 2017/0219275 A1 Aug. 3, 2017

(30) Foreign Application Priority Data

Oct. 15, 2014 (KR) ..... 10-2014-0139134

(51) Int. Cl.
*F25D 25/02* (2006.01)
*F25D 23/04* (2006.01)
*F25D 23/02* (2006.01)

(52) U.S. Cl.
CPC ..... *F25D 25/025* (2013.01); *F25D 23/04* (2013.01); *F25D 25/022* (2013.01); *F25D 23/025* (2013.01)

(58) Field of Classification Search
CPC ..... F25D 25/025; F25D 23/02; F25D 25/022; F25D 23/04; F25D 2323/021;
(Continued)

(56) References Cited

U.S. PATENT DOCUMENTS 5,303,563 A * 4/1994 Bishop ..... A23B 7/00 312/402
8,590,992 B2 * 11/2013 Lim ..... F25D 25/025 312/348.3
(Continued)

FOREIGN PATENT DOCUMENTS

CN 102472555 5/2012
CN 103256777 8/2013
(Continued)

OTHER PUBLICATIONS

International Search Report in International Application No. PCT/KR2015/010813, dated Feb. 2, 2016, 10 pages (with English translation).
(Continued)

*Primary Examiner* — Hiwot E Tefera
(74) *Attorney, Agent, or Firm* — Fish & Richardson P.C.

(57) ABSTRACT

Disclosed is a refrigerator. The refrigerator includes a cabinet having a first storage compartment, an inner door pivotably rotatably installed to the cabinet, the inner door having a second storage compartment, an outer door configured to open or close the second storage compartment, and a drawer installed in the second storage compartment, the drawer being movable forward and rearward. The drawer includes a basket part (120) configured to receive food therein and a frame unit (140) configured to allow the basket part (120) to be separably seated thereon.

15 Claims, 9 Drawing Sheets

(58) Field of Classification Search
CPC ..... F25D 2323/023; F25D 23/067; F25D 25/024; F25D 23/028; F25D 25/02; F25D 25/021; F25D 23/025; F25D 11/00; F25D 11/02; A47B 96/025; A47B 57/16; A47B 96/027; A47B 96/06; A47B 2210/175
USPC ..... 312/404, 402, 405, 405.1, 408
See application file for complete search history.

(56) References Cited

U.S. PATENT DOCUMENTS

| | | | | |
|---|---|---|---|---|
| 8,651,598 | B2 * | 2/2014 | Go | F25D 25/005 312/404 |
| 9,140,483 | B2 * | 9/2015 | Park | F25D 25/025 |
| 9,360,246 | B2 * | 6/2016 | Haltmeyer | F25D 25/025 |
| 9,513,047 | B2 * | 12/2016 | Chellappan | F25D 23/04 |
| 9,816,746 | B1 * | 11/2017 | Haney | F25D 23/028 |
| 9,915,470 | B2 * | 3/2018 | Kim | F25D 25/025 |
| 2010/0175404 | A1 * | 7/2010 | Kim | F25D 23/04 62/264 |
| 2012/0018435 | A1 * | 1/2012 | Kim | F25D 23/04 220/592.02 |
| 2012/0293056 | A1 * | 11/2012 | Kim | F25D 23/04 312/405.1 |
| 2013/0119845 | A1 * | 5/2013 | Seo | F25D 23/025 312/404 |
| 2013/0127323 | A1 * | 5/2013 | Seo | F25D 23/00 312/404 |
| 2013/0221823 | A1 * | 8/2013 | Fidalgo | F25D 25/025 312/404 |
| 2014/0239790 | A1 * | 8/2014 | Yoo | F25D 25/025 312/404 |
| 2014/0265807 | A1 * | 9/2014 | Kendall | F25D 25/021 312/408 |
| 2014/0300264 | A1 * | 10/2014 | Park | F25D 25/025 312/404 |
| 2017/0082351 | A1 * | 3/2017 | Jung | F25D 11/02 |
| 2017/0276423 | A1 * | 9/2017 | Jung | F25D 23/028 |
| 2017/0299255 | A1 * | 10/2017 | Kim | F25D 25/025 |

FOREIGN PATENT DOCUMENTS

| | | |
|---|---|---|
| KR | 10-2010-0037361 | 4/2010 |
| KR | 10-20110037361 | 4/2011 |
| KR | 10-20110089792 | 8/2011 |
| KR | 10-2012-0006723 | 1/2012 |
| KR | 10-20140105687 | 9/2014 |
| WO | 20140129769 | 8/2014 |

OTHER PUBLICATIONS

Extended European Search Report in European Application No. 15851155, dated Oct. 23, 2017, 7 pages (with English translation).
Office Action in Chinese Application No. 201580035176.3, dated Sep. 3, 2018, 15 pages (with English Translation).

* cited by examiner

[Fig. 1]
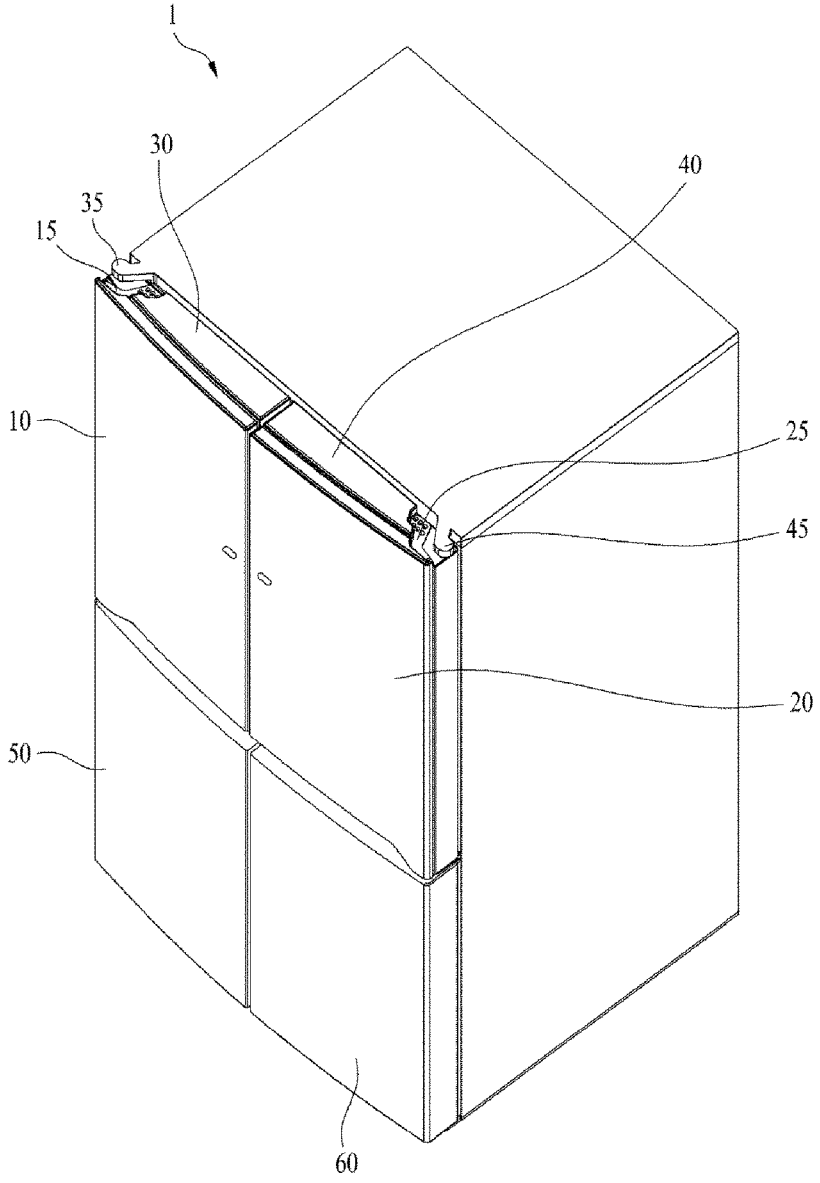

[Fig. 2]
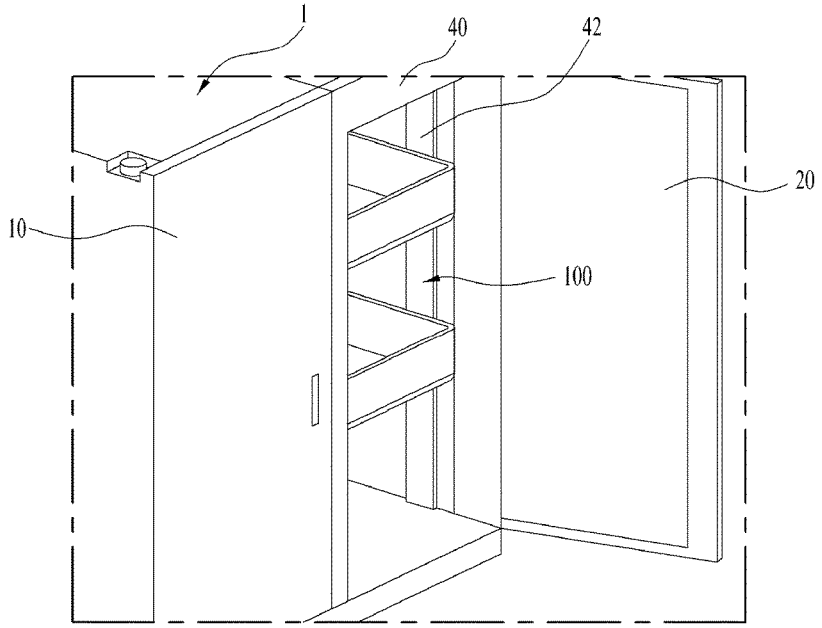

[Fig. 3]
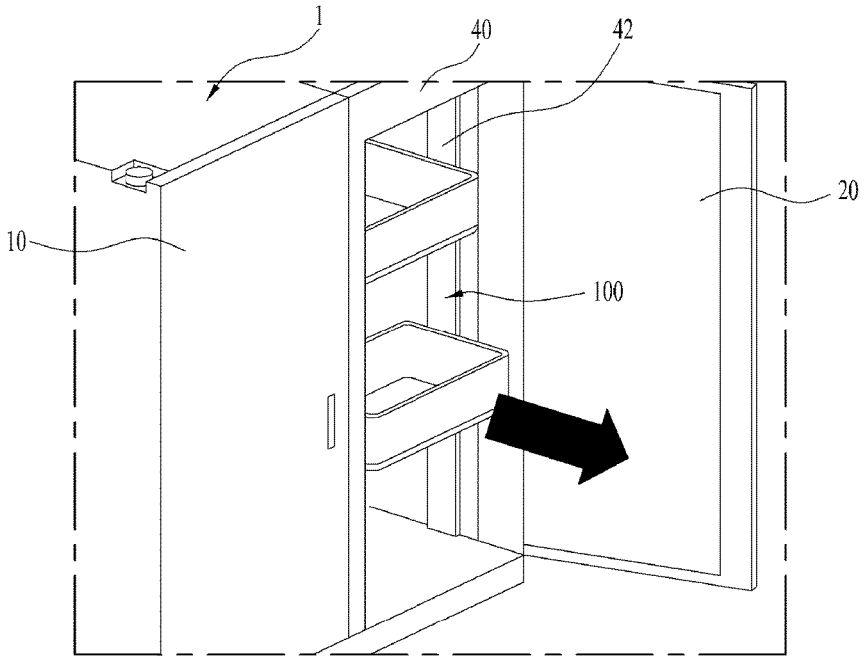

[Fig. 4]
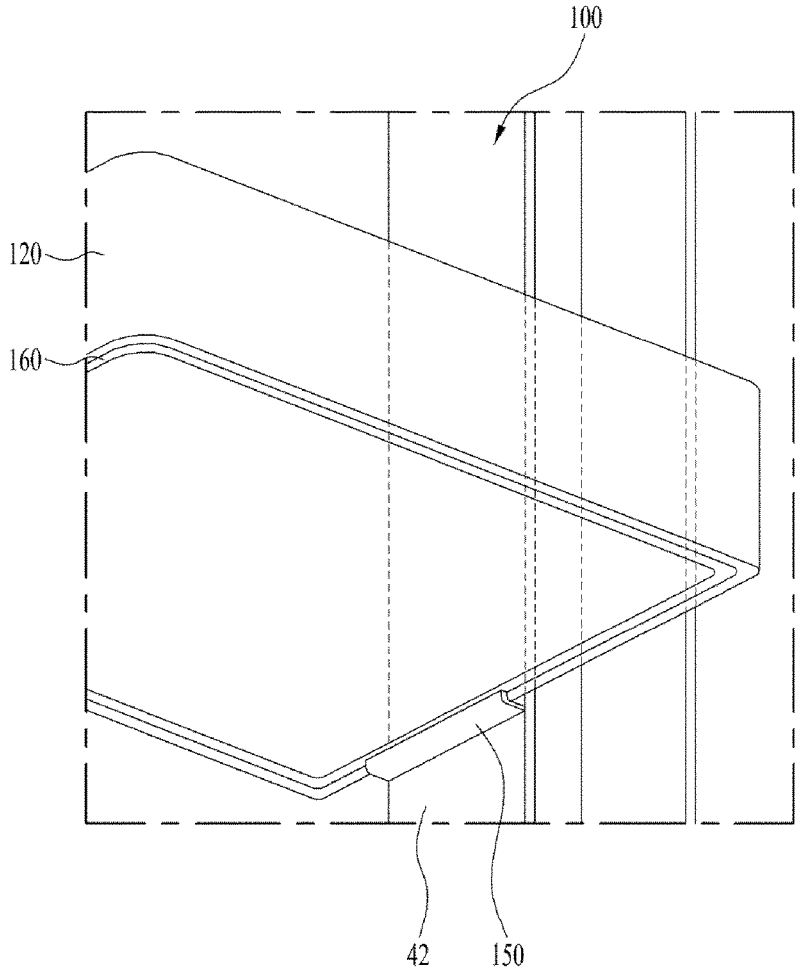

[Fig. 5]
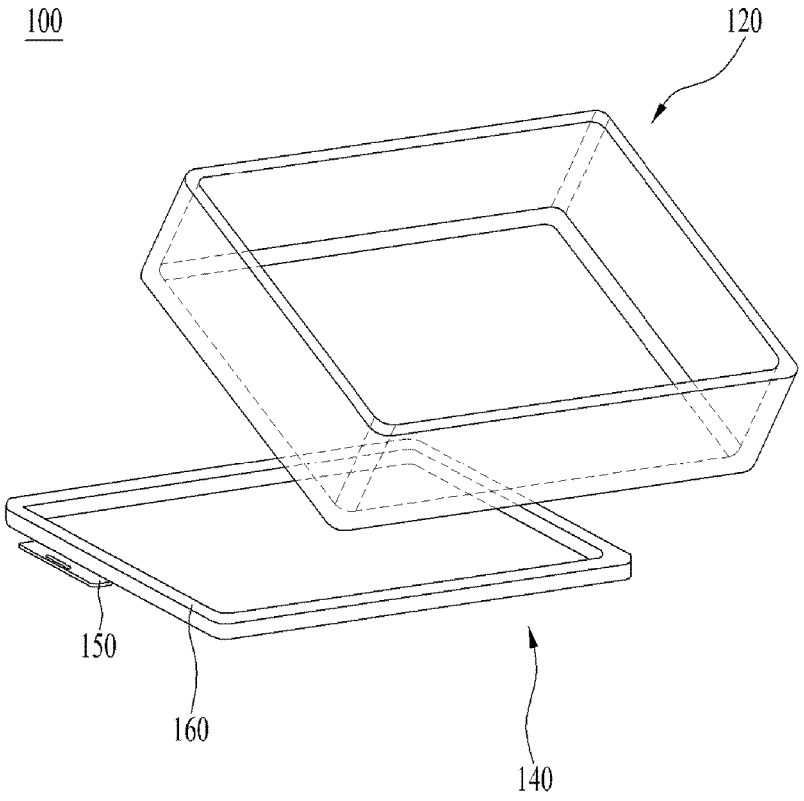

[Fig. 6]
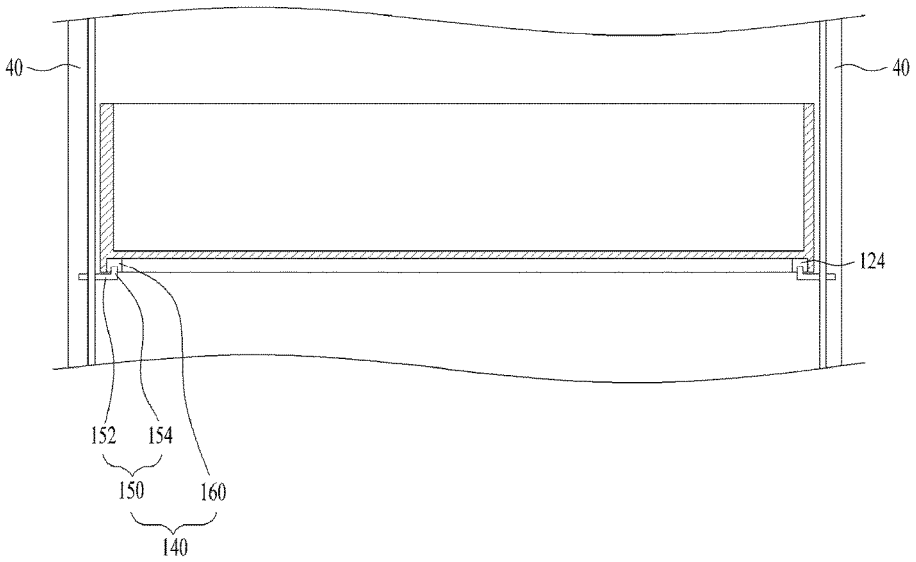

[Fig. 7]
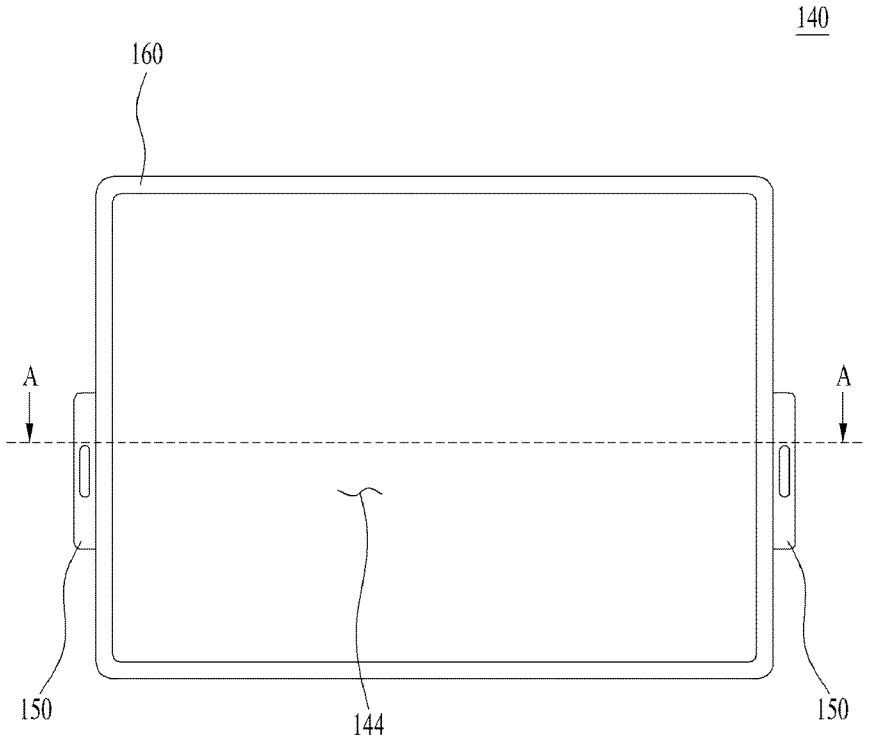

[Fig. 8]
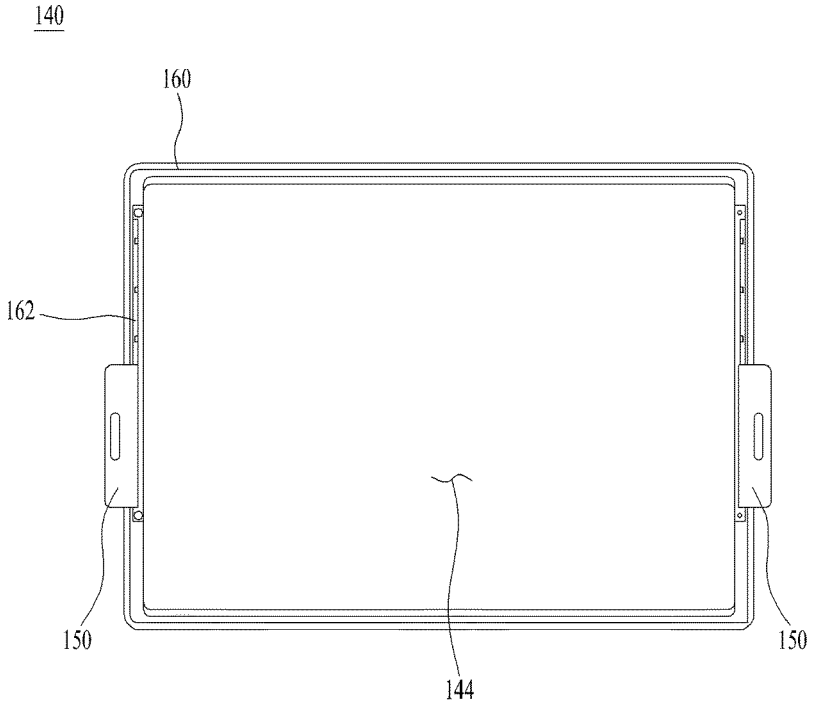

[Fig. 9]
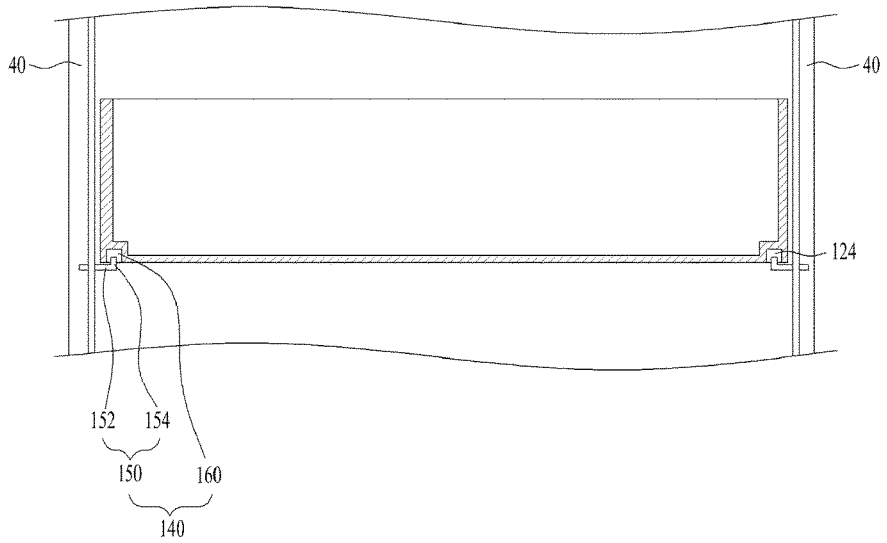

REFRIGERATOR

CROSS REFERENCE TO RELATED APPLICATIONS

This application is a U.S. National Phase Application under 35 U.S.C. § 371 of International Application PCT/KR2015/010813, filed on Oct. 14, 2015, which claims the benefit of Korean Application No. 10-2014-0139134, filed on Oct. 15, 2014, the entire contents of which are hereby incorporated by reference in their entireties.

TECHNICAL FIELD

The present invention relates to a refrigerator and, more particularly, to a refrigerator which is capable of improving the usage of space by an inner door.

BACKGROUND ART

In general, a refrigerator is an apparatus that keeps food stored therein at a temperature below freezing or less or at a temperature slightly above freezing by discharging cold air, generated via a refrigeration cycle comprised of, for example, a compressor, a condenser, an expansion valve, and an evaporator, so as to lower the temperature inside the refrigerator.

The refrigerator typically includes storage compartments including a freezing compartment in which foods or beverages are kept frozen and a refrigerating compartment in which foods or beverages are kept cold.

There are several kinds of refrigerators including a top-mount type refrigerator in which a freezing compartment is located above a refrigerating compartment, a bottom freezer type refrigerator in which a freezing compartment is located below a refrigerating compartment, and a side-by-side type refrigerator in which a freezing compartment and a refrigerating compartment are divided into left and right sides.

The refrigerator has recently been increased in capacity, and baskets are provided inside a door to define a space for receiving items to be stored for the sake of efficient utilization of the receiving space.

In a refrigerator equipped with an inner door and an outer door which open or close a cabinet, a basket installed on the inner door is stationary, rather than movable. Therefore, there is user inconvenience when retrieving food received in the basket installed on the inner door.

In addition, refrigerators according to the related art have a problem in that the storage capacity of the basket is reduced because the structure for securing the basket, installed on the inner door, is large.

DISCLOSURE OF INVENTION

Technical Problem

Therefore, the present invention has been made in view of the above problems, and it is one object of the present invention to provide a refrigerator which may ensure the efficient use of storage space provided on an inner door.

In addition, it is another object of the present invention to provide a refrigerator which may improve the convenience with which a user uses the storage space provided on an inner door.

Solution to Problem

In accordance with one aspect of the present invention, the above and other objects can be accomplished by the provision of a refrigerator including a cabinet having a first storage compartment, an inner door pivotably rotatably installed to the cabinet, the inner door having a second storage compartment, an outer door configured to open or close the second storage compartment, and a drawer installed in the second storage compartment, the drawer being movable forward and rearward, wherein the drawer includes a basket part configured to receive food therein and a frame unit configured to allow the basket part to be separably seated thereon.

The basket part may have, formed in a lower surface thereof, a fixing groove, indented to a prescribed depth to enable insertion of the frame unit.

The fixing groove may take the form of a rectangle conforming to the shape of the lower surface of the basket part.

The frame unit may include a central hollow region, and the basket part may be provided with a protrusion configured to be inserted into and coupled to the hollow region.

The frame unit may include a coupling member coupled to the inner door, and a support member movably coupled to the coupling member, the support member being configured to support the basket part seated thereon.

The coupling member may have a shorter length in a front-and-rear direction than the support member.

The length of the coupling member in the front-and-rear direction may be shorter than a length of the inner door in the front-and-rear direction.

The coupling member may include a horizontal piece extending from the inner door in a horizontal direction, and a vertical piece extending perpendicular to the horizontal piece, the vertical piece being coupled to the support member.

The support member may be formed with a guide groove for movement of the coupling member in a front-and-rear direction.

The basket part may be formed of a transparent material.

The frame unit may include two first members extending in a front-and-rear direction, and two second members connecting the two first members to each other.

The first members and the second members may respectively be connected to each other and define a hollow rectangle therein.

The first members may have a shorter length in a front-and-rear direction than the basket part.

The second members may have a shorter length in a left-and-right direction than the basket part.

The drawer may be configured to be pulled out and forward when the outer door is in an open state.

The drawer may include a plurality of drawers, and the drawers may be arranged on the inner door at different heights.

A distance between the drawers may be greater than a height of the drawers.

The basket part may have an open top and may define an empty rectangular space in an interior thereof.

Advantageous Effects of Invention

According to the present invention, the size of the storage space provided on an inner door is increased, which may improve the efficiency of use of the space.

In addition, according to the present invention, the user can conveniently use the storage space provided on the inner door.

BRIEF DESCRIPTION OF DRAWINGS

The accompanying drawings, which are included to provide a further understanding of the invention, illustrate embodiments of the invention and together with the description serve to explain the principle of the invention.

In the drawings:

FIG. 1 is a perspective view of a refrigerator according to an embodiment of the present invention;

FIG. 2 is a view illustrating the state in which an outer door is opened and a drawer is not pulled out;

FIG. 3 is a view illustrating the state in which the drawer of FIG. 2 is pulled out;

FIG. 4 is a view illustrating the drawer of FIG. 2 when viewed from the bottom;

FIG. 5 is a view illustrating the separated state of the drawer;

FIG. 6 is a front sectional view illustrating the state in which the drawer is coupled to the outer door;

FIG. 7 is a view illustrating a frame unit when viewed from the top;

FIG. 8 is a view illustrating the frame unit when viewed from the bottom; and FIG. 9 is a view illustrating an alteration of a basket unit.

BEST MODE FOR CARRYING OUT THE INVENTION

Hereinafter, exemplary embodiments of the present invention to concretely realize the objects described above will be described in detail with reference to the accompanying drawings.

In the drawings, the shape, size, or the like of components may be exaggerated for clarity and convenience. In addition, the terms particularly defined in consideration of configurations and operations of the present invention may be replaced by other terms based on intensions of those skilled in the art or customs. The meanings of these terms may be construed based on the overall content of this specification.

FIG. 1 is a perspective view of a refrigerator according to an embodiment of the present invention, The refrigerator according to the embodiment illustrated in FIG. 1 is a bottom freezer type refrigerator in which a refrigerating compartment is located in the upper region of a cabinet 1 and a freezing compartment is located in the lower region of the cabinet 1.

A pair of inner doors 30 and 40 is pivotably rotatably mounted, via hinges 35 and 34, to the left and right sides of the upper front portion of the cabinet 1 in order to open or close the refrigerating compartment.

A pair of outer doors 10 and 20 is pivotably rotatably mounted, via a pair of hinges 15 and 25, to one side of the front surface of the respective inner doors 30 and 40, so as to open or close a storage space (first storage compartment) provided on the inner doors 30 and 40.

When the user opens the outer doors 10 and 20, the user can access a storage space (second storage compartment) defined in the inner doors 30 and 40.

A door configured to open or close the lower freezing compartment may include a pair of pivotably rotatably mounted freezing compartment doors 50 and 60. The freezing compartment door may include a single door configured to be pulled out or pushed in.

Of course, in the embodiment of the present invention, instead of installing the inner doors and the outer doors to the left and right sides as described above, a single door may be installed only on the left side, or the inner door and the outer door may be installed only on the right side.

In addition, the present invention may be applied to an embodiment of a refrigerator in which a freezing compartment is provided in the upper region and a refrigerating compartment is provided in the lower region.

FIG. 2 is a view illustrating the state in which the outer door is opened and a drawer is not pulled out, and FIG. 3 is a view illustrating the state in which the drawer of FIG. 2 is pulled out.

Referring to FIGS. 2 and 3, the cabinet 1 may include a first storage compartment in which food may be stored, the inner door 40 may be pivotably rotatably installed to the cabinet 1 and may include a second storage compartment 42, and the outer door 20 may open or close the second storage compartment 42.

That is, the inner door 40 and the outer door 20 are pivotably rotatably installed to the cabinet 1 so as to allow the user to access the respective storage compartments.

A drawer 100 is installed in the second storage compartment 42 and is configured to be movable forward and rearward. As exemplarily illustrated in FIGS. 2 and 3, the drawer 100 may be movable forward and rearward relative to the inner door 40, thereby allowing the user to pull the drawer 100 out and access food stored in the drawer 100.

The drawer 100 may be pulled out toward the user, which may increase the convenience with which the user accesses the drawer 100. Once the drawer 100 has been pulled out from the inner door 40, it is possible to prevent the user's hand or arm from being caught by a frame of the inner door 40 when the user accesses the food stored in the drawer 100, or to prevent the frame of the inner door 40 from inconveniently blocking the user's view.

In addition, as will be described below, when a portion of the drawer 100 is separated from the inner door 40, the portion of the drawer 100 that is accessible to the user increases, which may assist the user in easily separating a portion of the drawer 100 from the inner door 40.

FIG. 4 is a view illustrating the drawer of FIG. 2 when viewed from the bottom, and FIG. 5 is a view illustrating the separated state of the drawer.

Referring to FIGS. 4 and 5, the drawer 100 includes a basket part 120 in which food is received, and a frame unit 140 on which the basket part 120 is separably seated.

The basket part 120 may have an approximately rectangular shape having an open top. The user may put food into the basket part 120 through the open top of the basket part 120.

The frame unit 140 may be coupled to support the basket part 120. At this time, the frame unit 140 and the basket part 120 may not be coupled using, for example, bolts, in order to ensure that the user can easily separate the two from each other.

The basket part 120 may be coupled so as to be placed on the top of the frame unit 140. As such, the user can easily separate the basket part 120 from the frame unit 140.

For reference, FIG. 5 illustrates the state in which the frame unit 140 is separated from the inner door 40.

FIG. 6 is a front sectional view illustrating the state in which the drawer is coupled to the outer door, FIG. 7 is a view illustrating the frame unit when viewed from the top, and FIG. 8 is a view illustrating the frame unit when viewed from the bottom.

Referring to FIGS. 6 to 8, the basket part 120 may have a fixing groove 124 formed therein, which is indented to a prescribed depth to allow the frame unit 140 to be inserted into the lower surface of the basket part 120. The fixing groove 124 may be configured such that the entire horizontal cross-section thereof has a rectangular shape to conform to the shape of the lower surface of the basket part 120.

In addition, one side of the fixing groove 124 may have the same cross-section as the frame unit 140 so as to be fitted into the frame unit 140.

As exemplarily illustrated in FIG. 6, the fixing groove 124 may be located on either side of the lower surface of the basket part 120 such that the frame unit 140 is coupled to the respective fixing groove 124.

The fixing groove 124 may be formed so as not to be exposed from the side surface of the basket part 120. This is because, when the fixing groove 124 is exposed from the side surface of the basket part 120, it is difficult to reduce the left-and-right shaking of the basket part 120 when force that causes excessive shaking is applied.

Therefore, as exemplarily illustrated in FIG. 6, the coupling region of the frame unit 140 and the fixing groove 124 may be configured to allow the basket part 120 to extend downward at the exterior of the frame unit 140.

As exemplarily illustrated in FIGS. 7 and 8, the frame unit 140 has a rectangular shape overall, and a hollow region 144 is defined in the inner space of the rectangular frame unit 140. Providing the frame unit 140 with the hollow region 144 may reduce the total weight of the frame unit 140.

Since the lower portion of the basket part 120 is wholly supported by the frame unit 140, the weight of the basket part 120 is wholly transmitted to the frame unit 140 despite the provision of the hollow region 144, which may allow the drawer 100 to stably move in the front-and-rear direction.

The frame unit 140 may include a coupling member 150 coupled to each inner door 40 and a support member 160 movably coupled to the coupling member 150, the basket part 120 being seated on the support member 160.

The support member 160, as exemplarily illustrated in FIG. 6, may have a rectangular front cross-section, so as to be fitted into the fixing groove 124.

As exemplarily illustrated in FIGS. 7 and 8, the coupling member 150 may have a shorter front-and-rear length than the support member 160.

The coupling member 150 is a part of the drawer 100 which substantially comes into contact with the inner door 40 so as to be coupled to the inner door 40. The support member 160 serves to transmit the weight of the basket part 120 to the coupling member 150. In order to stably support the weight of the basket part 120, the bottom cross-section of the basket part 120 and the bottom cross-section of the support member 160 may be substantially similar to each other.

The reason for this is to uniformly distribute the weight of the basket part 120 over the entire support member 160, rather than being concentrated on any region thereof, making it possible to prevent any disadvantage such as, for example, overturning of the basket part 120 when the drawer 100 is pulled out or pushed in by the user.

The length of the coupling member 150 in the front-and-rear direction may be shorter than the length of the inner door 40 in the front-and-rear direction. With respect to the term "front-and-rear direction", the front is the direction facing the front surface of the cabinet 1 when the user views the cabinet 1 from in front of the cabinet 1, and the rear is the direction facing the inside of the cabinet 1, opposite to the front.

The drawer 100 may be pushed into and pulled out from the inner door 40. Typically, the drawer 100 may have a longer front-and-rear length than the inner door 40. This cause the front-and-rear length of the drawer 100 to be longer than the length of the portion of the drawer 100 that is coupled to the inner door 40.

Securing sufficient front-and-rear length of the drawer 100 is necessary in order to ensure a given length or more so as to store a given amount of food or more in the drawer 100 and to ensure that the drawer 100 substantially functions as a storage space in which food is stored.

The support member 160 may be formed with a guide groove 162 in which each coupling member 150 is movable in the front-and-rear direction.

The coupling member 150 may have an approximately "L"-shaped form overall. The coupling member 150 may include a horizontal piece 152 horizontally extending from the inner door 40, and a vertical piece 154 extending perpendicular to the horizontal piece 152.

In the embodiment of the present invention, through the provision of the horizontal piece 152 and the vertical piece 154, components constituting the interior configuration of the second storage compartment 42 may be simplified compared to the related art.

In particular, the horizontal piece 152 functions to couple the inner door 40 and the drawer 100 to each other, and the vertical piece 154 functions to allow the drawer 100 to move in the front-and-rear direction. Therefore, additional components such as, for example, a roller, may be omitted, which eliminates the use of a complicated configuration to move or support the drawer 100. Accordingly, the drawer 100 may have a relatively increased space for food storage and a greater amount of food may be stored in the inner door 40.

That is, the horizontal piece 152 extends inward of the inner door 40 by a short length, which may provide a relatively wide space in the width direction of the drawer 100.

The vertical piece 154 extends upward of the inner door 40 by a short length, which may provide a relatively wide space in the vertical direction of the drawer 100.

In particular, the vertical piece 154 may be inserted into the guide groove 162 so as to move in the guide groove 162 in the front-and-rear direction. As such, when the user moves the basket part 120 in the front-and-rear direction, the path along which the vertical piece 154 is movable is defined in the guide groove 162, which may allow the user to easily access the basket part 120.

In addition, when attempting to separate the basket part 120 from the drawer 100, the separation may be inconvenient due to the heavy weight of the basket part 120 in the state in which food is stored in the basket part 120. In this case, the drawer 100 may move toward the user. Through this movement, when the user accesses the basket part 120 of the drawer 100, the user receives less interference from the inner door 40 or another drawer 100, and sufficient space for the user to grip the basket part 120 may be provided.

That is, according to the embodiment of the present invention, it is possible to assist the user in easily accessing the basket part 120 to store or retrieve food and to easily separate or couple the basket part 120 from or to the inner door 40.

Meanwhile, the basket part 120 may be formed of a transparent material. A plurality of drawers 100 may be installed to the inner door 40 at different heights. When the user checks respective foods received in the drawers 100, the upper drawer may need to be configured so as to allow the user to view the lower drawer. Thus, when the entire basket part 120 is transparent, it may be possible to prevent the upper drawer from blocking the transmission of light to the lower drawer, which may make it more convenient for the user to use the lower drawer.

FIG. 9 is a view illustrating an alteration of the basket part.

The alteration of FIG. 9 is identical to the above-described embodiment excluding a protrusion formed at the bottom of the basket part 120. Hereinafter, only the protrusion will be described, and descriptions related to the other parts will be omitted.

Referring to FIG. 9, the basket part 120 may be provided with a protrusion 128 configured to be inserted into the hollow region 144.

That is, the protrusion 128 may protrude downward from the lower surface of the basket part 120 so as to surround both the left and right sides of the frame unit 140. As such, the extent of coupling the basket part 120 to the frame unit 140 may be increased.

The frame unit 140 may include two first members extending in the front-and-rear direction, and two second members connecting the two first members to each other. The first members and the second members may be connected to one another to define a hollow rectangle therein. That is, the frame unit 140 has a rectangular shape overall and is in contact with the basket part 120 in the front-and-rear direction and in the left-and-right direction. As such, the weight of the basket part 120 may be wholly transmitted to the frame unit 140, and therefore it is possible to prevent the weight of the basket part 120 from being concentrated on a portion of the frame unit 140. Since the weight of the basket part 120 is uniformly distributed and supported along the entire outline of the basket part 120, the basket 120 may be stably pushed into and pulled out and may be stably supported even if the weight of the basket part 120 is increased.

The first member may be shorter than the front-and-rear length of the basket part 120, and the second member may be shorter than the left-and-right length of the basket part 120. Thus, since the frame unit 140 is smaller than an outer circumferential portion of the basket part 120, the frame unit 140 may support the basket part 120 without being exposed to the user.

The drawer 100 may be pulled out and forward when the outer door 20 is in an open state. The user may rotate only the outer door 20 and pull out the basket part 120 while accessing the second storage compartment in the state in which the inner door 40 is stationary at the cabinet 1. At this time, the basket part 120 may be pulled out and forward toward the user. Of course, the user may pull out the outer door 20 and the inner door 40, and may differentiate the rotation angles of the outer door 20 and the inner door 40, such that the basket part 20 is pulled out in the state in which the outer door 20 and the inner door 40 are separated from each other.

The drawers 100 may be arranged at the inner door 40 at different heights. In this case, the distances between the drawers may be greater than the heights of the drawers in order to achieve an access region in which the user separates the basket part 120 from the frame unit 140 so as to take out the basket part 120.

The basket part 120 may internally define am empty cuboidal space having an open top side. Thus, the user may access the top of the basket part 120 to store food in the empty space of the basket part 120 through the top of the basket part 120.

It will be apparent that, although the preferred embodiments have been shown and described above, the disclosure is not limited to the above-described specific embodiments, and various modifications and variations can be made by those skilled in the art without departing from the gist of the appended claims. Thus, it is intended that the modifications and variations should not be understood independently of the technical spirit or prospect of the disclosure.

MODE FOR THE INVENTION

As described above, a related description has sufficiently been discussed in the above "Best Mode" for implementation of the present invention.

INDUSTRIAL APPLICABILITY

As described above, the present invention may be wholly or partially applied to a refrigerator.

The invention claimed is:

1. A refrigerator comprising:

a cabinet with a first storage compartment;

an inner door rotatably installed to the cabinet, the inner door having a second storage compartment;

an outer door configured to open or close the second storage compartment; and a drawer installed in the second storage compartment, the drawer being configured to move forward and rearward, wherein the drawer includes a basket part configured to receive food and a frame unit configured to allow the basket part to be separably seated on the frame unit, wherein the frame unit includes:

a coupling member coupled to the inner door; and a support member movably coupled to the coupling member, the support member being configured to support the basket part seated on the support member, wherein the support member includes:

two first members configured to extend in a front-and-rear direction; and two second members configured to connect the two first members to each other, wherein the coupling member includes:

a horizontal piece that is configured to extend from the inner door in a horizontal direction, and coupled to a side surface of the inner door; and a vertical piece that is configured to extend perpendicular to the horizontal piece, the vertical piece being coupled to a bottom surface of one of the two first members, wherein the first members and the second members are respectively connected to each other and define a hollow rectangle, wherein the frame unit is configured to transfer the weight of the basket part into the inner door, wherein the basket part is above the coupling member, and wherein a bottom of the basket part is lower than a top of the support member, and wherein the support member includes a central hollow region, and wherein the basket part is provided with a protrusion configured to be inserted into and coupled to the hollow region.

2. The refrigerator according to claim 1, wherein the basket part has, formed in a lower surface of the basket part, a fixing groove, indented to a prescribed depth to enable insertion of the frame unit.

3. The refrigerator according to claim 2, wherein the fixing groove takes the form of a rectangle conforming to the shape of the lower surface of the basket part.

4. The refrigerator according to claim 1, wherein the coupling member has a shorter length in a front-and-rear direction than the support member.

5. The refrigerator according to claim 1, wherein the length of the coupling member in the front-and-rear direction is shorter than a length of the inner door in the front-and-rear direction.

6. The refrigerator according to claim 1, wherein the support member is formed with a guide groove for the coupling member.

7. The refrigerator according to claim 1, wherein the basket part is formed of a transparent material.

8. The refrigerator according to claim 1, wherein the first members have a shorter length in a front-and-rear direction than the basket part.

9. The refrigerator according to claim 1, wherein the second members have a shorter length in a left-and-right direction than the basket part.

10. The refrigerator according to claim 1, wherein the drawer is configured to be pulled out and forward when the outer door is in an open state.

11. The refrigerator according to claim 1, wherein the drawer includes a plurality of drawers, and the drawers are arranged on the inner door at different heights.

12. The refrigerator according to claim 11, wherein a distance between the drawers is greater than a height of the drawers.

13. The refrigerator according to claim 1, wherein the basket part has an open top and defines an empty rectangular space in an interior thereof.

14. The refrigerator according to claim 1, wherein the inner door is coupled to the cabinet by a hinge and configured to open or close the first storage compartment.

15. The refrigerator according to claim 1, wherein the second storage compartment is longer than the drawer in a front-and-rear direction.

* * * * *